US005984730A

United States Patent [19]

Lu

[11] Patent Number: 5,984,730

[45] Date of Patent: Nov. 16, 1999

[54] WATERPROOF ELECTRIC PLUG WITH FUSE HOLDER

[76] Inventor: Chong-Ying Lu, 12F-1, No. 311, Chung-Hsiao E. Road, Sec. 4, Taipei, Taiwan

[21] Appl. No.: 08/859,119

[22] Filed: May 20, 1997

[51] Int. Cl.[6] ..... H01R 13/68; H01R 33/945

[52] U.S. Cl. ..... 439/622

[58] Field of Search ..... 439/621, 622

[56] References Cited

U.S. PATENT DOCUMENTS 4,274,698 6/1981 Ahroni ..... 439/622

4,834,664 5/1989 Lin ..... 439/621

5,482,478 1/1996 Liao ..... 439/622

*Primary Examiner*—Gary Paumen

*Assistant Examiner*—Katrina Davis

*Attorney, Agent, or Firm*—Rosenberg, Klein & Bilker

[57] ABSTRACT

The present invention relates to a waterproof electric plug with fuses that comprises a housing, a fuse holder, a fuse cover, two plug blades, two tubular fuses, and power lines. When the cover and the holder are inserted into the housing, the complicated structure that is formed will prevent any water or liquid from entering into the housing and the holder. The cover can be pushed to expose an opening in the housing through which the tubular fuses can be replaced.

1 Claim, 6 Drawing Sheets

WATERPROOF ELECTRIC PLUG WITH FUSE HOLDER

BACKGROUND OF THE INVENTION

1. Field of the Invention

The present invention relates to a waterproof plug, and more particularly to a waterproof plug having a housing, a fuse holder, a cover, two plug blades, two fuses, and power lines with elastic terminal strips.

2. Prior Art

The conventional power plug for an electrical appliance or an extension power line is usually integrally molded for water resistance, but have no structure for protecting the circuit form overcurrent. There are some recent power plug products designed to provide a fuse therein. However, there is no waterproof structure designed for that type of power plug.

SUMMARY OF THE INVENTION

It is therefore an object of the present invention to provide a plug structure having a fuse-holder and being waterproof.

BRIEF DESCRIPTION OF THE DRAWINGS

The present invention can be better understood by detailed description of the following drawings, in which.

DETAILED DESCRIPTION OF THE INVENTION

Figure 1:
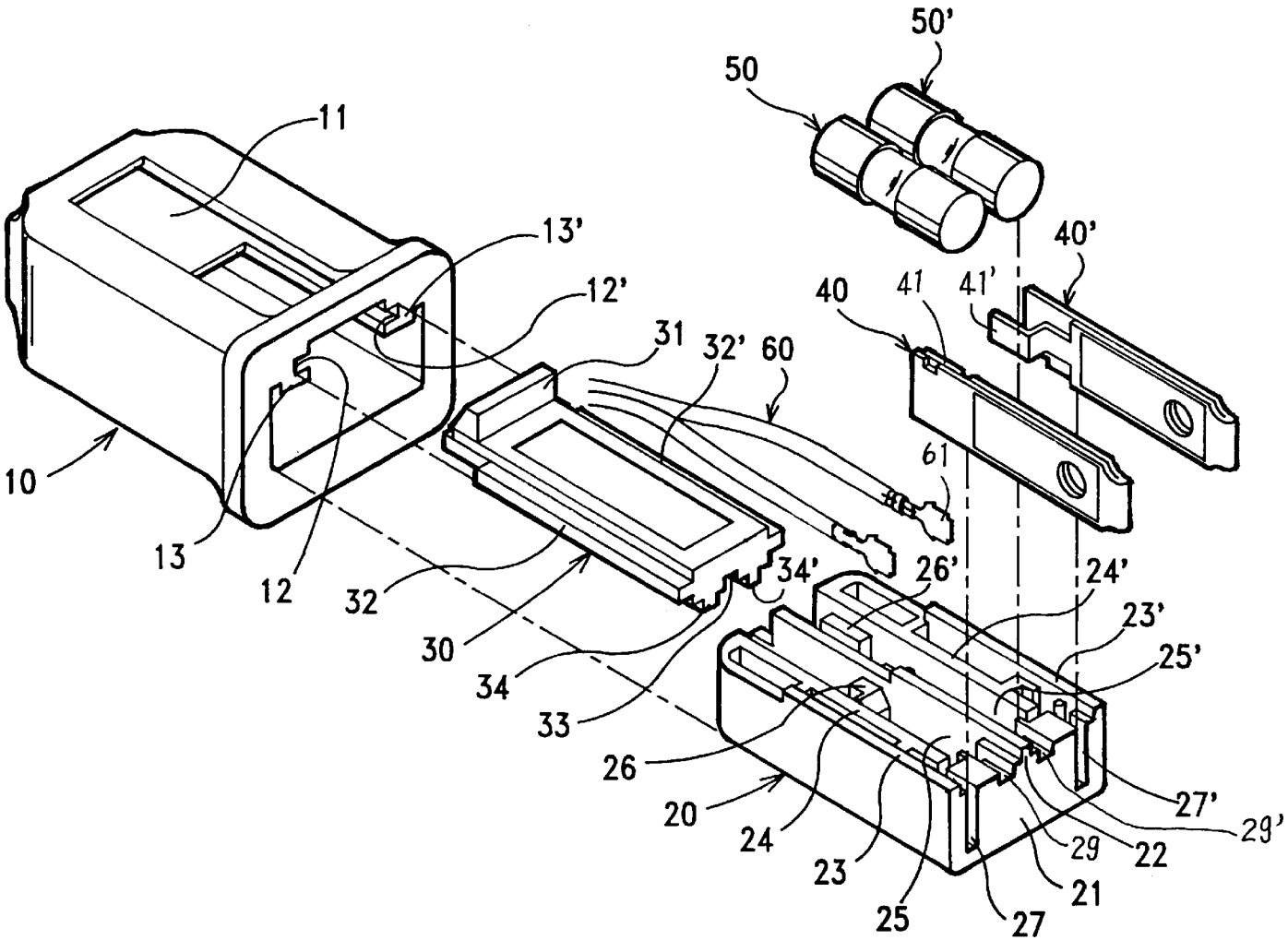
FIG. 1 is an exploded perspective view of the present invention.
Figure 2:
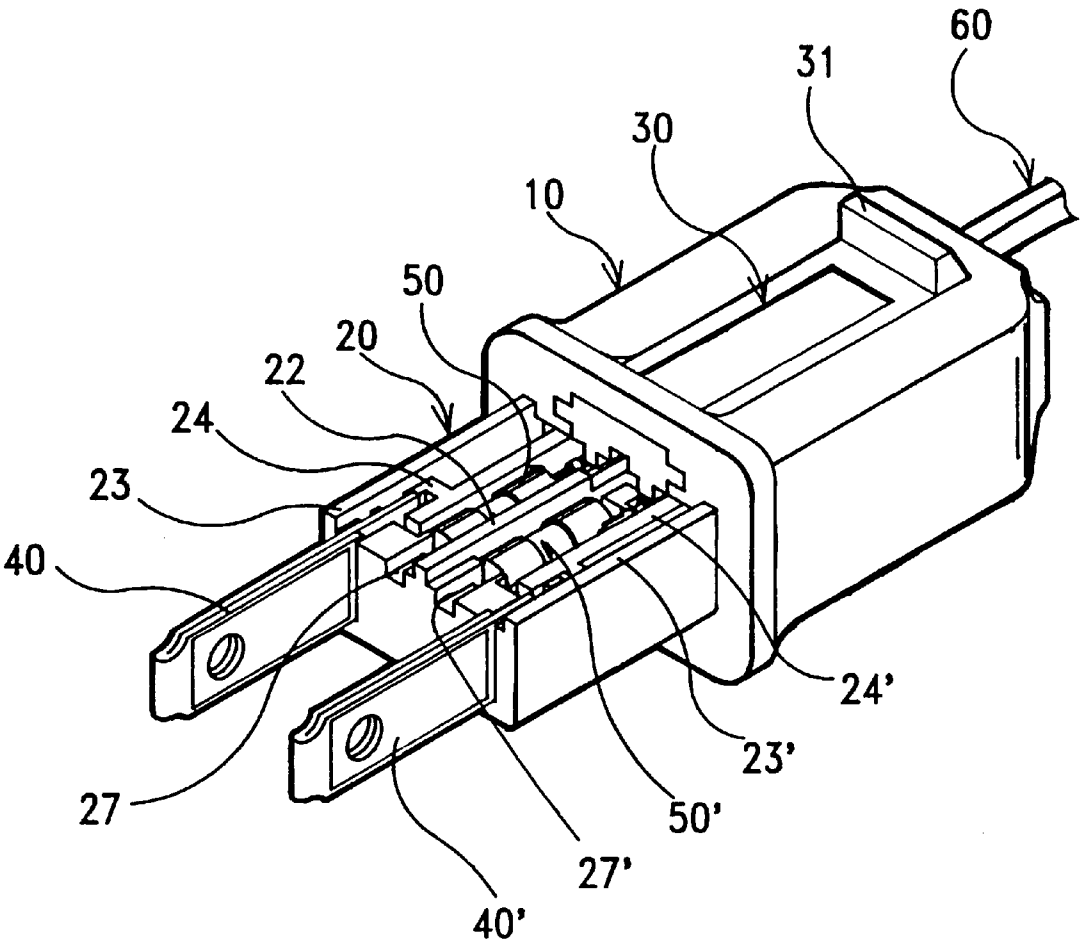
FIG. 2 is a partly assembled perspective view of the present invention.
Figure 3:
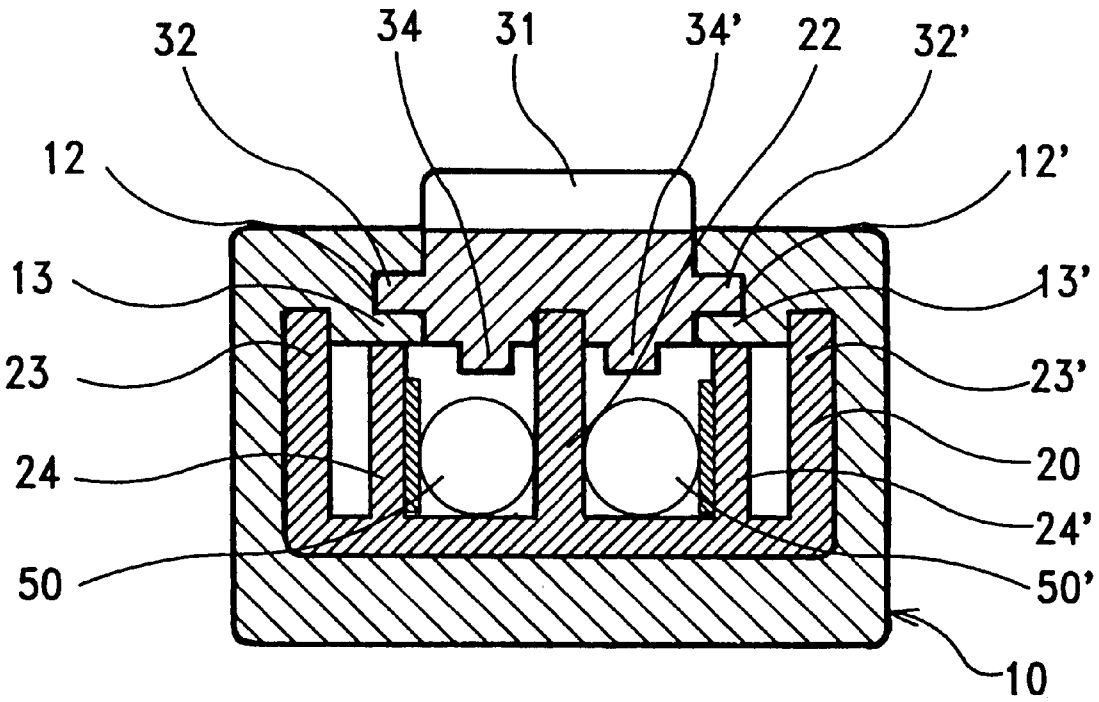
FIG. 3 is a side cross-sectional view of the present invention shown in FIG. 2.

Referring to FIGS. 1, 2, and 3, such show a preferred embodiment of the present invention. As shown in the Figures, the present invention comprises a housing 10; a fuse holder 20; a cover 30; two plug blades 40, 40' with elastic terminal contactors 41, 41'; two tubular fuses 50, 50'; and, power lines 60 with elastic terminal strips 61.

The housing 10 is generally a rectangular structure with a hollow interior having openings at two ends thereof. The upper surface of the housing 10 is provided with an opening with a slot 11 having two grooves 12, 12' at two sides of the opening 11 respective defined by two horizontal flanges 13, 13'.

The holder 20 is inserted into the hollow interior of the housing 10 and is divided into a plurality of troughs by a middle wall 22 and two outer side walls 23, 23' having the same height, and two dividing walls 24, 24' with a lower height provided between the middle wall and the side walls respectively. Thus two accommodating spaces 25, 25' are formed between the dividing walls and the middle wall for receiving two tubular fuses therein. The fuse holder has two stopping blocks 26, 26' formed therein for trapping the power lines 60 that are inserted from the back end of the holder 20, and provide a strain-relief effect therefor. Two slots 27, 27' are disposed at a front wall 21 near the outer side walls 23, 23' for fixing two plug blades 40, 40' therein. Two slot mortises 29, 29' are disposed in the front wall 21 adjacent two sides of the middle wall 22.

Two tubular fuses 50, 50' are respectively disposed between the contactors 41, 41' of the two plug pieces 40, 40' and the terminal strips 61 of the power line 60 making an electrical connection therebetween.

The cover 30 is a rectangular plate having a push plate 31 on a top portion thereof at the back end thereof. Two sliding strips 32, 32' are formed at two side edges of the cover 30, and a recess 33 disposed at a bottom center portion of the cover 30. Two projecting strips 34, 34' are disposed on two sides of the bottom of the cover 30, nearby and in parallel with the recess 33.

When the cover 30 and the holder 20 are inserted into the housing 10, the sliding strips 32, 32' of the cover 30 will be inserted into the two grooves 12, 12' of the housing 10, respectively. The middle wall 22 of the holder 20 will be disposed in the recess 33 of the cover 30. The strip projections 34, 34' of the cover 30 will respectively be positioned in the slot mortises 29, 29' of the holder 20, and the two dividing walls 24, 24' will respectively abut the two horizontal flanges 13, 13'.

Therefore, the complicated structure will prevent any water or liquid from entering into the housing 10 and the holder 20.

Figure 4:
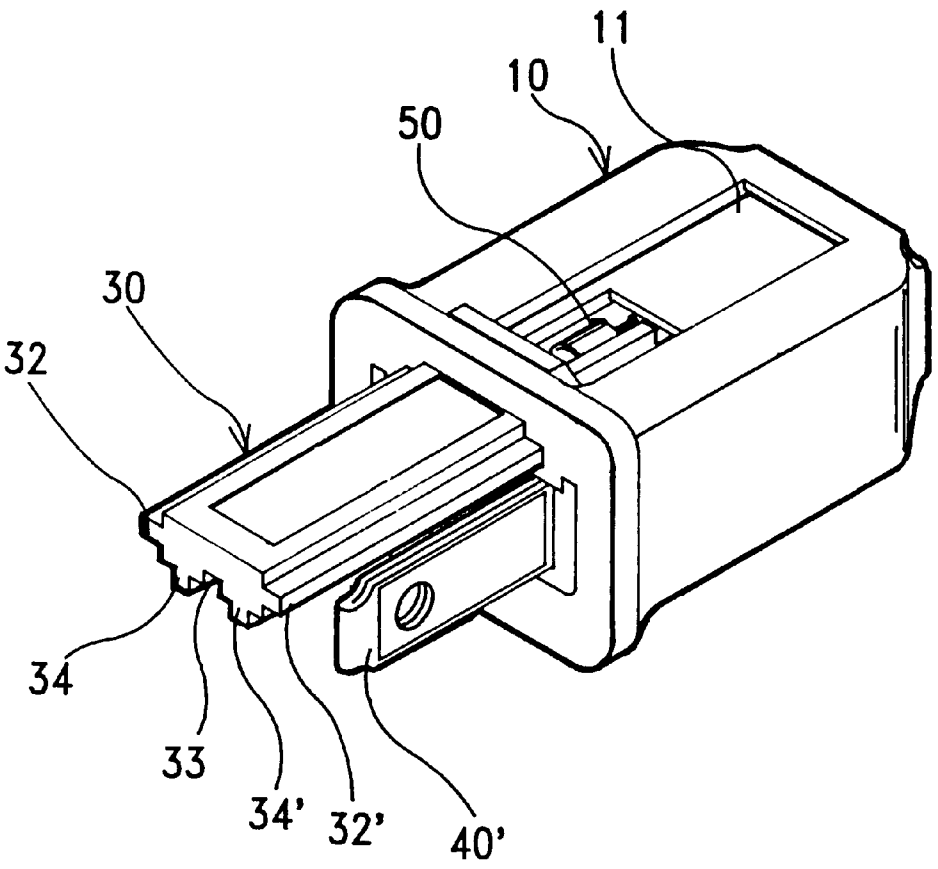
FIG. 4 is a perspective view showing the replacement of the fuses of the present invention.

In order to replace the fuses 50, 50', as shown in FIG. 4, the push plate 31 is pushed along in the direction of the plug blades 40, 40', to the end. Therefore, it is very convenient to replace the fuses.

Figure 5:
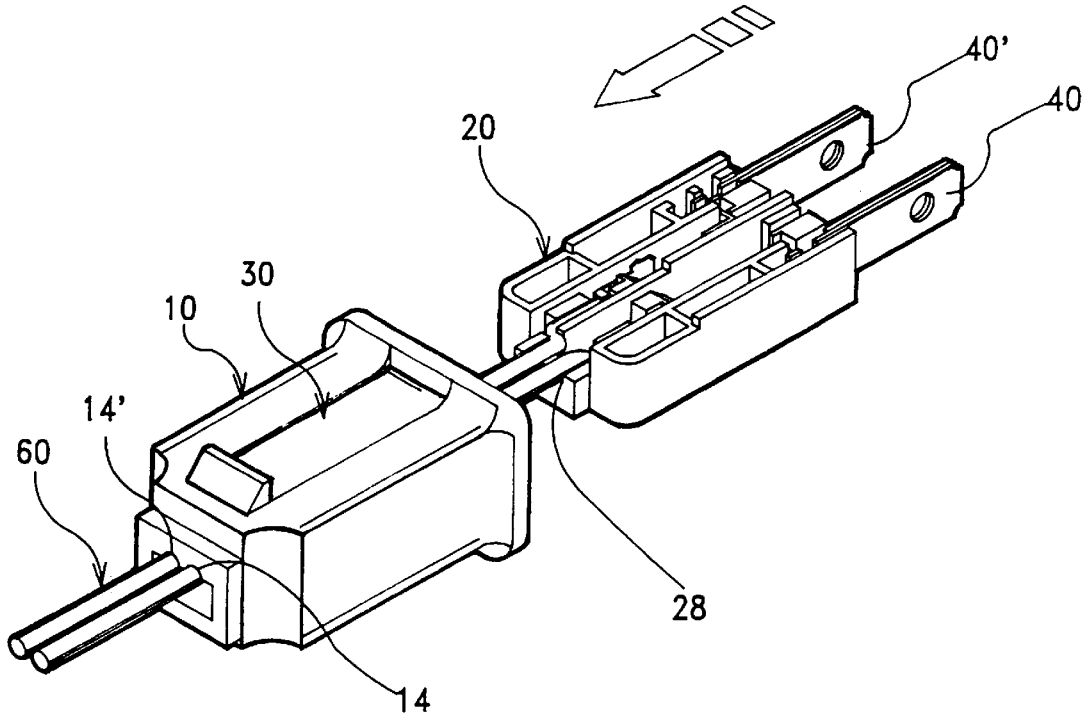
FIG. 5 is a perspective view showing the assembly of the housing and the holder of the present invention; and, FIGS. 6A and 6B show a respective perspective view and a side view of the present invention with power lines being disposed through the back end of the power plug.
Figure 6A:
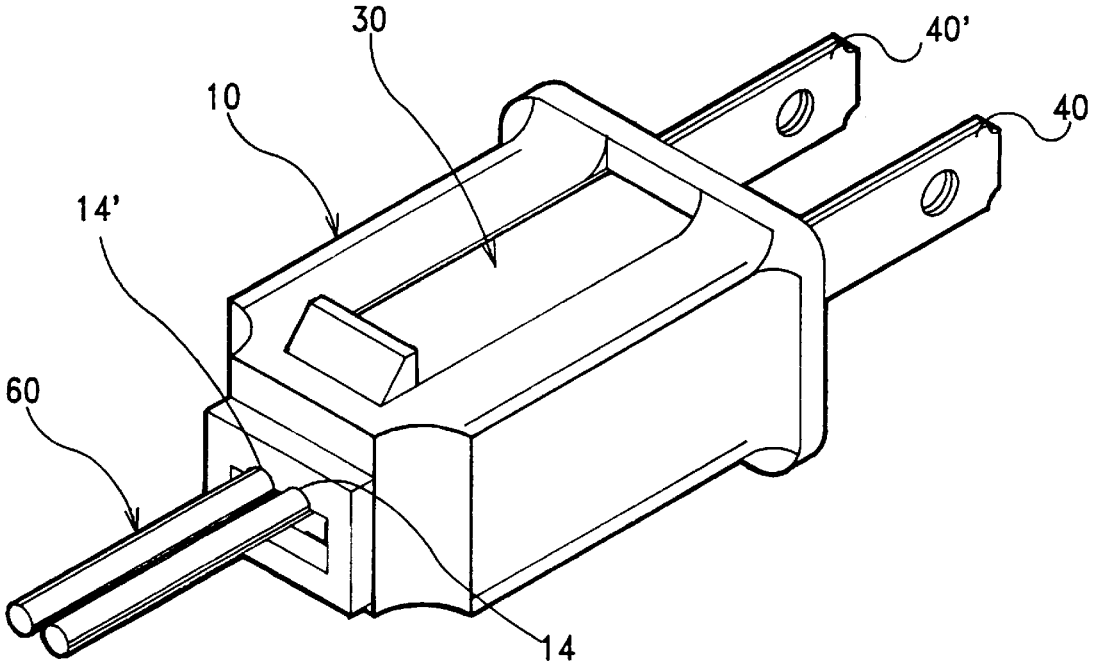
Figure 6B:
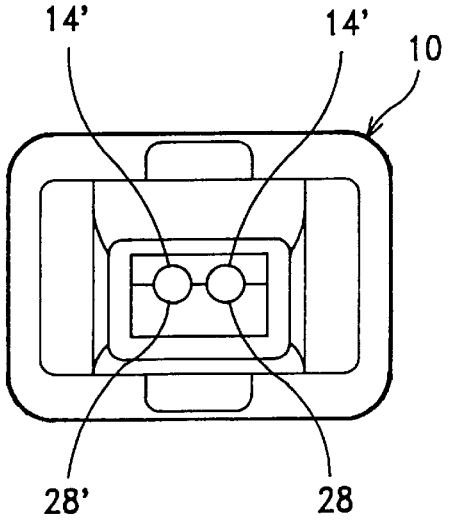

Referring to FIGS. 5, 6A, and 6B, each of the back ends of the holder 20 and the housing 10 is formed with circular grooves 28, 28' and 14, 14' that are combined to define two holes that tightly hold the power lines 60 passing therethrough and thereby achieve a waterproofing effect.

There is no doubt that after reading the above descriptions any skillful person in the art can create many different variations without departing from the spirit and scope of the accompanying claims. Therefore, it is intended that the appended claims will cover all those variations.

I claim:

1. A waterproof electric plug with fuses, comprising:

a housing having a substantially rectangular contour and a hollow interior, said housing having openings formed in opposing front and rear ends thereof in open communication with said hollow interior, said rear end having a pair of semi-circular grooves formed therein, said housing having an upper wall with an opening formed therethrough, and a pair of horizontal flanges formed on opposing sides of said upper wall opening and extending from a lower surface of the upper wall, said pair of flanges defining a pair of grooves disposed on opposing sides of said upper wall opening;

a fuse holder inserted into said hollow interior of said housing, said fuse holder having a pair of outer side walls and a middle wall disposed between said outer side walls for dividing said fuse holder into a pair of spaces for respectively receiving tubularly shaped fuses therein, each of said pair of spaces having a stopping block formed therein for trapping a respective power line in said space, said fuse holder having a front wall with a pair of slotted openings and a pair slot mortises formed therethrough, said fuse holder having a rear wall with a pair of semi-circular grooves formed therein for combination with said semi-circular grooves of said rear end of said housing for defining a pair of holes to tightly hold respective power lines;

a pair of plug blades disposed in said fuse holder and having a front end extending through said pair of slotted openings, each tubularly shaped fuse being connected between a rear end of a respective one of said pair of plug blades and a respective power line terminal;

a rectangular cover having (a) a push plate formed adjacent an end portion of said cover and extending from an upper surface thereof, (b) a pair of sliding strips respectively formed on opposing sides thereof for slidable engagement with said pair of grooves disposed on opposing sides of said upper wall opening, (c) a pair of strips projecting downwardly from a lower surface of said cover for insert into said pair slot mortises, and (d) a recess formed between said projecting strips for receiving an upper portion of said middle wall therein.

* * * * *